US008161957B2

(12) United States Patent
Maeda

(10) Patent No.: US 8,161,957 B2
(45) Date of Patent: Apr. 24, 2012

(54) TOY GUN

(75) Inventor: Tetsuo Maeda, Tokyo (JP)

(73) Assignee: Maruzen Company Limited, Tokyo (JP)

( * ) Notice: Subject to any disclaimer, the term of this patent is extended or adjusted under 35 U.S.C. 154(b) by 0 days.

(21) Appl. No.: 12/923,941

(22) Filed: Oct. 15, 2010

(65) Prior Publication Data

US 2011/0265775 A1 Nov. 3, 2011

(30) Foreign Application Priority Data

Apr. 28, 2010 (JP) ..... 2010-102951

(51) Int. Cl.
*F41B 11/00* (2006.01)

(52) U.S. Cl. ..... 124/73

(58) Field of Classification Search ..... 124/73, 124/76, 77

See application file for complete search history.

(56) References Cited

U.S. PATENT DOCUMENTS

| | | | | |
|---|---|---|---|---|
| 4,936,282 | A * | 6/1990 | Dobbins et al. | 124/74 |
| 5,078,118 | A * | 1/1992 | Perrone | 124/74 |
| 5,257,614 | A * | 11/1993 | Sullivan | 124/73 |
| 5,339,791 | A * | 8/1994 | Sullivan | 124/73 |
| 5,349,938 | A * | 9/1994 | Farrell | 124/73 |
| 5,778,868 | A * | 7/1998 | Shepherd | 124/76 |
| 6,026,797 | A | 2/2000 | Maeda et al. | |
| 2004/0089280 | A1 * | 5/2004 | Kunimoto | 124/76 |
| 2005/0028802 | A1 * | 2/2005 | Jones | 124/73 |
| 2005/0115550 | A1 * | 6/2005 | Jones | 124/65 |
| 2005/0115554 | A1 * | 6/2005 | Jones | 124/74 |
| 2006/0027221 | A1 * | 2/2006 | Farrell | 124/31 |
| 2007/0119988 | A1 | 5/2007 | Sheng | |
| 2007/0209650 | A1 * | 9/2007 | Jones | 124/73 |
| 2007/0227519 | A1 * | 10/2007 | Wood | 124/73 |

FOREIGN PATENT DOCUMENTS

| | | | |
|---|---|---|---|
| CH | 341408 | A | 9/1959 |
| EP | 1 677 066 | A1 | 7/2006 |
| JP | 10-197200 | A | 7/1998 |
| WO | WO-2008/075999 | A1 | 6/2008 |

OTHER PUBLICATIONS

Extended European Search Report, App. No. 10014513.5-1260, Jan. 25, 2011 (4 pages).

Extended European Search Report issue Dec. 22, 2011 for corresponding European Applcation No. 11 00 8917.

* cited by examiner

*Primary Examiner* — Troy Chambers

(74) *Attorney, Agent, or Firm* — Rader, Fishman & Grauer PLLC

(57) ABSTRACT

A valve body is in a cylindrical shape and communicates with the rear-side end of a barrel on the front side. The valve body forms an air chamber therein. A discharge valve is positioned in the valve body. The discharge valve is hit by a bolt from behind and thereby opens or shuts the communication between the barrel and the air chamber. When the bolt makes forward or backward slide movement, the valve body is fit into a first opening at the front part of the bolt. The cylindrical portion or the closed end of the bolt is provided with a second opening through which the air in the bolt flows in or out.

14 Claims, 11 Drawing Sheets

TOY GUN

CROSS REFERENCE TO RELATED APPLICATION

The present application is based on and claims the benefit of priority of Japanese Patent Application No. 2010-102951 filed on Apr. 28, 2010, the entire contents of which is incorporated herein by reference.

TECHNICAL FIELD

The present invention relates to a toy gun so configured that a bolt is moved by a user pulling a trigger, the bolt opens a valve to jet compressed gas out, and a bullet is fired off by pressure arising from this compressed gas.

BACKGROUND

There are conventionally toy guns used by toy gun enthusiasts for fun in target shooting (plinking) or the like at home. These toy guns are so configured that a bolt is moved by a user pulling a trigger, the bolt opens a valve to jet compressed gas out, and a bullet is fired off by pressure arising this compressed gas. (An example is the automatic toy gun described in Japanese Unexamined Patent Publication No. Hei 10 (1998)-197200.)

The automatic toy gun described in Japanese Unexamined Patent Publication No. Hei 10 (1998)-197200 is of open bolt type. Brief description will be given to the action of a forward/backward action bolt 11 observed when bullets are fired off from this automatic toy gun. When the trigger 1 is pulled with the forward/backward action bolt 11 in a standby position close to the rear end of the gun, the following takes place: a recoil spring 27 pushes the forward/backward action bolt 11 and a hammer 21 integrally provided on the forward/backward action bolt 11 hits a opening/closing valve member 51 (valve). As the result of hitting by the hammer 21, a bullet BB receives gas pressure and is accelerated in the direction toward the front end of a gunbarrel 2 and fired off from the gun. Substantially immediately after the bullet BB is fired off from the gunbarrel 2, the forward/backward action bolt 11 starts to move back in turn due to gas pressure from an accumulator 50 and the biasing force of a rebound spring 29.

Many toy gun users request of a toy gun that it not only fires off bullets but also provides functions and the sense of use similar to those of real guns. In a toy gun so configured that a valve is opened and closed in conjunction with the movement of a bolt in the back and forth direction of a gunbarrel and a bullet is thereby loaded and fired off, the following is implemented: high impact is produced by the movement of the bolt and this makes it possible to obtain the sense of use close to that of a real gun. Toy guns so configured that a bolt is moved and bullets are thereby fired off are more popular than toy guns with a fixed bolt.

The toy gun described in Japanese Unexamined Patent Publication No. Hei 10 (1998)-197200 is so configured that the following is implemented: a bolt moves forward and hits a valve and thereby opens the valve to fire off a bullet; and after the bolt thereafter moves back, the valve is closed. As mentioned above, this toy gun provides the sense of use close to that of a real gun. In case of this toy gun, however, the hammer, the valve, and bullets are not positioned in alignment. If the hammer, the valve, and bullets exist in alignment, it must be possible to further reduce the size of a bullet firing mechanism and more efficiently apply gas pressure to bullets. Aside from the automatic toy gun described in Japanese Unexamined Patent Publication No. Hei 10 (1998)-197200, an open bolt-type toy gun in which a hammer, a valve, and bullets exist substantially in alignment is possible. This will be designated as toy gun in virtual case.

This toy gun in virtual case is equipped with a movable bolt. This bolt has at its rear part a space (variable volume pressure chamber) into which air or gas flows. This variable volume pressure chamber is a space into which gas flows after a bullet is fired off. Gas that flowed into this variable volume pressure chamber pushes the bolt backward by its pressure. As long as the variable volume pressure chamber is filled with gas, the gas continuously pushes the bolt backward. That is, the above bolt moves backward after a bullet is fired off. This bolt breaks away from a valve body immediately before it arrives at the backmost retreat position. This removes the airtightness in the bolt and the gas in the variable volume pressure chamber is discharged to the atmosphere. As a result, the pressure of the gas in the variable volume pressure chamber is reduced.

For this reason, the following takes place in the toy gun in virtual case: the time for which the bolt continuously receives pressure from gas is lengthened as the closed-end cylindrical portion forming the variable volume pressure chamber becomes longer. As a result, the recoil shock given to the user by the toy gun in virtual case is also increased.

However, as the closed-end cylindrical portion becomes longer, the distance that the bolt travels until it hits the hammer after being fit into the closed-end cylindrical portion is lengthened. As a result, the air in the closed-end cylindrical portion functions as if it were a buffer material (air cushion) and this reduces the impact by which the bolt hits the hammer. If an attempt is made to provide the bolt with a mechanism for adjusting the pressure of the air in the closed-end cylindrical portion to cope with this, a problem arises. The structure of the bolt is complicated and there is a possibility that the slide movement of the bolt is hindered and in addition a retrofit cost is increased.

SUMMARY

Accordingly, an object of the present invention is to produce high impact when a bullet is fired off and at the time of blowback with a toy gun so configured that a bullet is fired off by gas pressure without largely modifying the structure of its valve for controlling a jet of compressed gas.

According to the present invention, a toy gun includes a barrel extended in the back and forth direction of a gunbarrel, a valve body formed in the shape of a cylinder extended in the back and forth direction of the gunbarrel, having an air chamber to be filled with compressed gas formed therein, communicating with the rear-side end of the barrel on the front side, and having a through hole penetrating the valve body in the back and forth direction of the gunbarrel formed on the rear side, a discharge valve positioned in the valve body and so provided that the discharge valve can be displaced between a closed position where the communication between the barrel and the air chamber is shut and an open position, located in front of the closed position, where the communication between the barrel and the air chamber is opened, a discharge valve spring pushing the discharge valve backward and positioning the discharge valve in the closed position, a bolt provided so that the bolt can freely slide in the back and forth direction of the gunbarrel, including a fit receiving portion which has an opening and to which the outer circumferential surface of the valve body on the rear side is fit through the opening and an abutment portion provided on the bottom portion of the fit receiving portion opposite the opening, and displaced between a pressing position where the abutment portion is abutted against the discharge valve and the discharge valve is positioned in the open position and a retreat position, behind this pressing position, where the abutment portion is caused to break away from the discharge valve and a bolt spring pushing the bolt forward.

DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION

Description will be given to an embodiment with reference to FIG. 1 to FIG. 10. This embodiment will be designated as first embodiment for the convenience of explanation. This embodiment is an example in which the invention is applied to a continuous firing toy gun.

Figure 1:
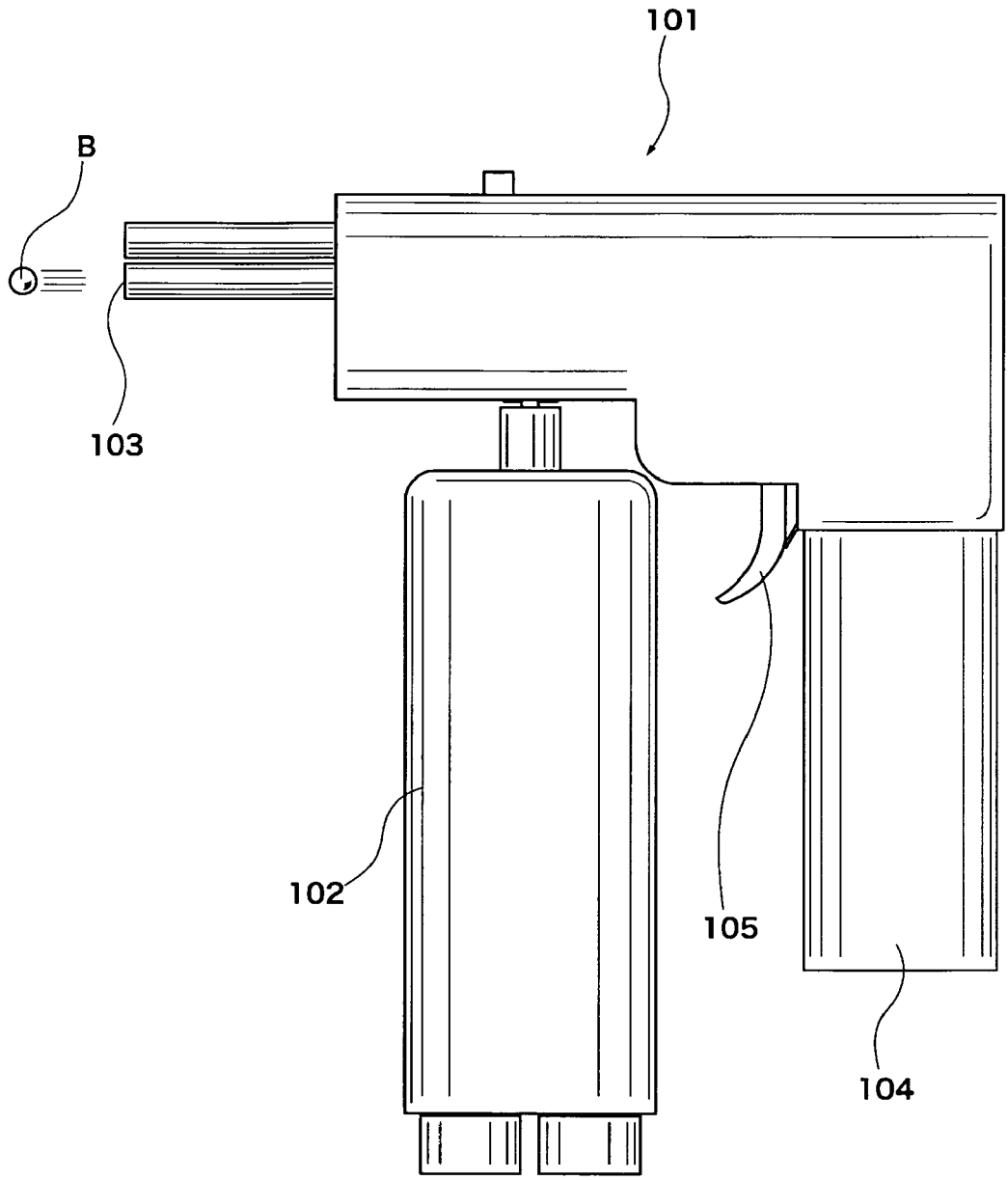
FIG. 1 is a left side view of a toy gun in a first embodiment.

FIG. 1 is a left side view of the toy gun 101. The toy gun 101 in this embodiment is a continuous firing toy gun used with a compressed gas cylinder 102 attached thereto. This toy gun 101 is so configured that the pressure of compressed gas filled in the compressed gas cylinder 102 is applied to a bullet B and the bullet B is thereby fired off from a muzzle 103. To use the toy gun 101, a user grasps its grip 104 with his/her hand and puts his/her finger on the trigger 105 and aims the muzzle 103 at a shooting target (for example, a mark). Then the user can fire off a bullet B from the muzzle 103 by moving his/her finger to pull the trigger 105 to the rear side of the toy gun 101.

Figure 2:
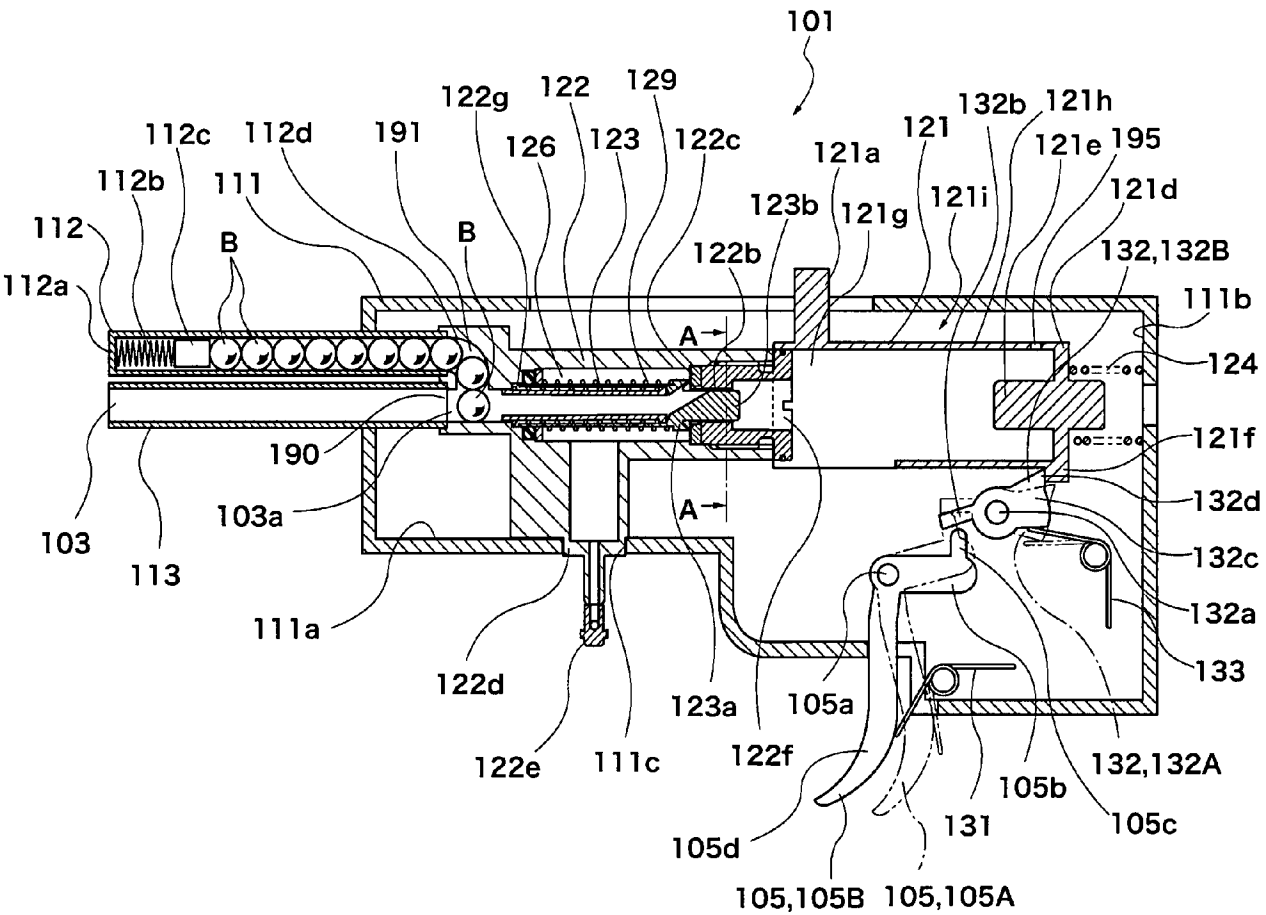
FIG. 2 is a left sectional view illustrating the internal structure of a toy gun.

FIG. 2 is a left sectional view illustrating the internal structure of the toy gun 101. In the following description, the side on which the muzzle 103 is positioned will be designated as the front side of the toy gun 101 and the side on which the grip 104 is positioned will be designated as the rear side of the toy gun 101.

First, description will be given to each part provided in the front portion of the toy gun 101. The toy gun 101 includes a frame 111 that forms an enclosure, a magazine 112 and a barrel 113. In this embodiment, the frame 111 forms part of the gunbarrel and defines the back and forth direction of the toy gun 101. The magazine 112 and the barrel 113 are protruded from the frame 111 forward of the toy gun 101. The magazine 112 and the barrel 113 may be not protruded from the frame 111 but be housed in the frame.

The magazine 112 is a cylindrical member with one end being a closed end 112*a* and is capable of housing bullets B therein. A magazine spring 112*b* is attached to the inner side face of the closed end 112*a* in the magazine 112. At the end of the magazine spring 112*b* on the opposite side to the closed end 112*a*, a magazine follower 112*c* that pushes bullets B is attached. Bullets B are guided into the magazine 112 through an open end 112*d* of the magazine 112. Instead, an opening may be provided in the magazine 112 in an appropriate place other than the open end 112*d* and a bullet B may be guided in through this opening. The magazine 112 with bullets B housed therein is attached to the front side of the frame 111 with its open end 112*d* pointed backward of the toy gun 101. The magazine 112 may be detachable from the frame 111 or may be fixed in the frame.

The barrel 113 is a cylindrical member and extended in the back and forth direction of the gunbarrel. The front end of the barrel 113 is the muzzle 103. The inside diameter of the barrel 113 is slightly larger than the diameter of each bullet B. The barrel 113 is positioned under the magazine 112 on the front side of the frame 111.

A bullet connection passage 190 is extended from the open end 103*a* of the barrel 113 on the opposite side to the muzzle 103. The bullet connection passage 190 is linearly extended in the back and forth direction of the body of the gun. The rear end of the bullet connection passage 190 communicates with the internal space of the discharge valve 123. (Refer to FIG. 4 as well.)

A bullet fall passage 191 is extended from the rear end (open end 112*d* side) of the magazine 112. The bullet fall passage 191 merges into the bullet connection passage 190. A bullet B in the magazine 112 is pushed out from the open end 112*d* by the magazine follower 112*c* and free-falls in the bullet fall passage 191. Then it arrives at a position corresponding to the open end 112*d* of the magazine 112 in the bullet connection passage 190. When compressed gas is jetted forward by the discharge valve 123 (described later) in this state, the bullet feed nozzle 192 (described later with reference to FIG. 4) is moved forward by gas pressure and pushes the rear face of the bullet B. Further, compressed gas that passed through the internal space of the bullet feed nozzle 192 pushes the rear face of the bullet B. As a result, the bullet B is pushed out forward by compressed gas passing through the bullet feed nozzle 192 and it passes through the interior of the barrel 113 and is shot forward out of the muzzle 103. (Refer to FIG. 9).

Description will be given to each part provided in the middle of the toy gun 101 with reference to FIG. 2. The toy gun 101 has, in the frame 111, the bolt 121, a valve body 122, the discharge valve 123, a bolt spring 124, packing 122*c*, and the discharge valve spring 129.

The bolt 121 is a cylindrical member extended in the back and forth direction of the toy gun 101. The bolt 121 is so provided that it can freely slide in the back and forth direction of the toy gun 101 and can reciprocate between a pressing position 121A (Refer to FIG. 5) and a retreat position 121B (Refer to FIG. 4). While it reciprocates once in the back and forth direction, the bolt 121 is abutted against and breaks away from the discharge valve 123 and thereby opens and shuts the communication between the barrel 113 and an air chamber 126 (described later).

The bolt 121 has a first opening 121*g* open forward. The bolt 121 has at its rear part a closed end 121*d* that forms the bottom portion opposite to the first opening 121*g*. The bolt 121 has a fit receiving portion 121*i* at its rear part. The fit receiving portion 121*i* has the first opening 121*g* and the closed end 121*d* at both its ends and its side face (cylindrical portion 121*h*) is cylindrically covered. The outer circumference of the valve body 122 on the rear side is fit into this fit receiving portion 121*i* through the first opening 121*g*.

One end of the bolt spring 124 is abutted against the outer surface of the closed end 121*d* of the bolt 121. The other end of the bolt spring 124 is abutted against the inner surface 111*b* of the rear part of the frame 111. The bolt spring 124 pushes forward the bolt 121 positioned in the retreat position 121B. (Refer to FIG. 4 as well.) The bolt spring 124 pushes the bolt 121 forward. After the bolt 121 makes slide movement and arrives at the forward position, it receives the pressure of compressed gas passing through the air gap S (described later) between a through hole 122*b* and a slide projection 123*b* and moves backward. The bolt 121 makes reciprocating motion of repeating the forward movement and the backward movement as mentioned above.

The bolt 121 has a locking projection 121*f*. The locking projection 121*f* is extended from the under surface of the bolt 121 on the closed end 121*d* side. Further, the bolt 121 has a protruded portion 121*a* protruded upward form its upper surface.

The bolt 121 has an abutment portion 121*e* on the inside surface side of the closed end 121*d*. The abutment portion 121*e* is fit into a fitting hole 122*f* (described next) located at the rear end of the valve body 122.

The valve body 122 is a cylindrical member extended in the back and forth direction of the gunbarrel and forms therein the air chamber 126 to be filled with compressed gas. The outside diameter of the valve body 122 is smaller than the inside diameter of the bolt 121. The valve body 122 enters the bolt 121 through the first opening 121*g* and can freely slide in the back and forth direction in the bolt 121. In the area at the front part of the toy gun 101 in the space in the valve body 122, a space 122*g* is ensured for the discharge valve 123 (described later) to slide forward.

The valve body 122 has a rear lid 122*a* at its rear end. The ring-shaped packing 122*c* is attached to the end face of the rear lid 122*a* facing forward. The rear lid 122*a* has the through hole 122*b*. The through hole 122*b* penetrates the rear lid in the back and forth direction of the gunbarrel and lets the exterior of the valve body 122 and the interior of the discharge valve 123 communicate with each other. The rear part of the through hole 122*b* forms the fitting hole 122*f* large in inside diameter. The abutment portion 121*e* provided on the bolt 121 is fit into the fitting hole 122*f* from outside the valve body 122. A slide projection 123*b* (described later) provided on the discharge valve 123 enters the through hole 122*b* from inside the valve body 122. This slide projection 123*b* is protruded to the fitting hole 122*f* side.

Figure 3:
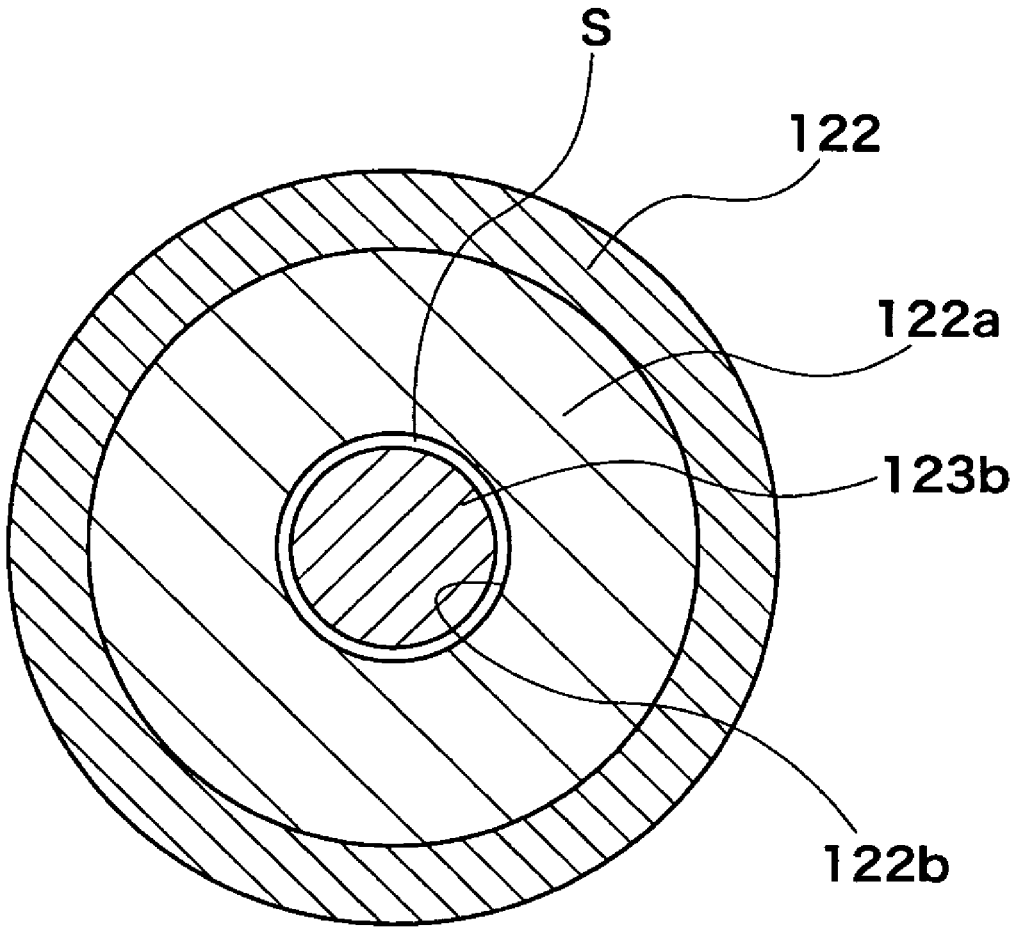
FIG. 3 is a sectional view taken along line A-A of FIG. 2.

FIG. 3 is a sectional view taken along line A-A of FIG. 2. The slide projection 123*b* has such a shape that it can enter the through hole 122*b* in the rear lid 122*a*. When it enters the through hole 122*b*, the slide projection 123*b* forms an air gap S between it and the inner circumferential surface of the through hole 122*b*.

Description will be given with reference to FIG. 2 again. The valve body 122 has a gas introducing portion 122*d*. The gas introducing portion 122*d* is protruded downward from the under surface of the valve body 122. The gas introducing portion 122*d* is hollow and lets the space in the valve body 122 and the space outside the frame 111 communicate with each other. The gas introducing portion 122*d* is fit into an attachment hole 111*c* formed in the inner bottom face 111*a* of the frame 111. As a result, the tip 122*e* of the gas introducing portion 122*d* is protruded downward of the frame 111. The compressed gas cylinder 102 (not shown in FIG. 2) is attached to this tip 122*e* of the gas introducing portion 122*d*. The compressed gas cylinder 102 feeds compressed gas into air chamber 126 (described later) through this gas introducing portion 122*d*.

Figure 4:
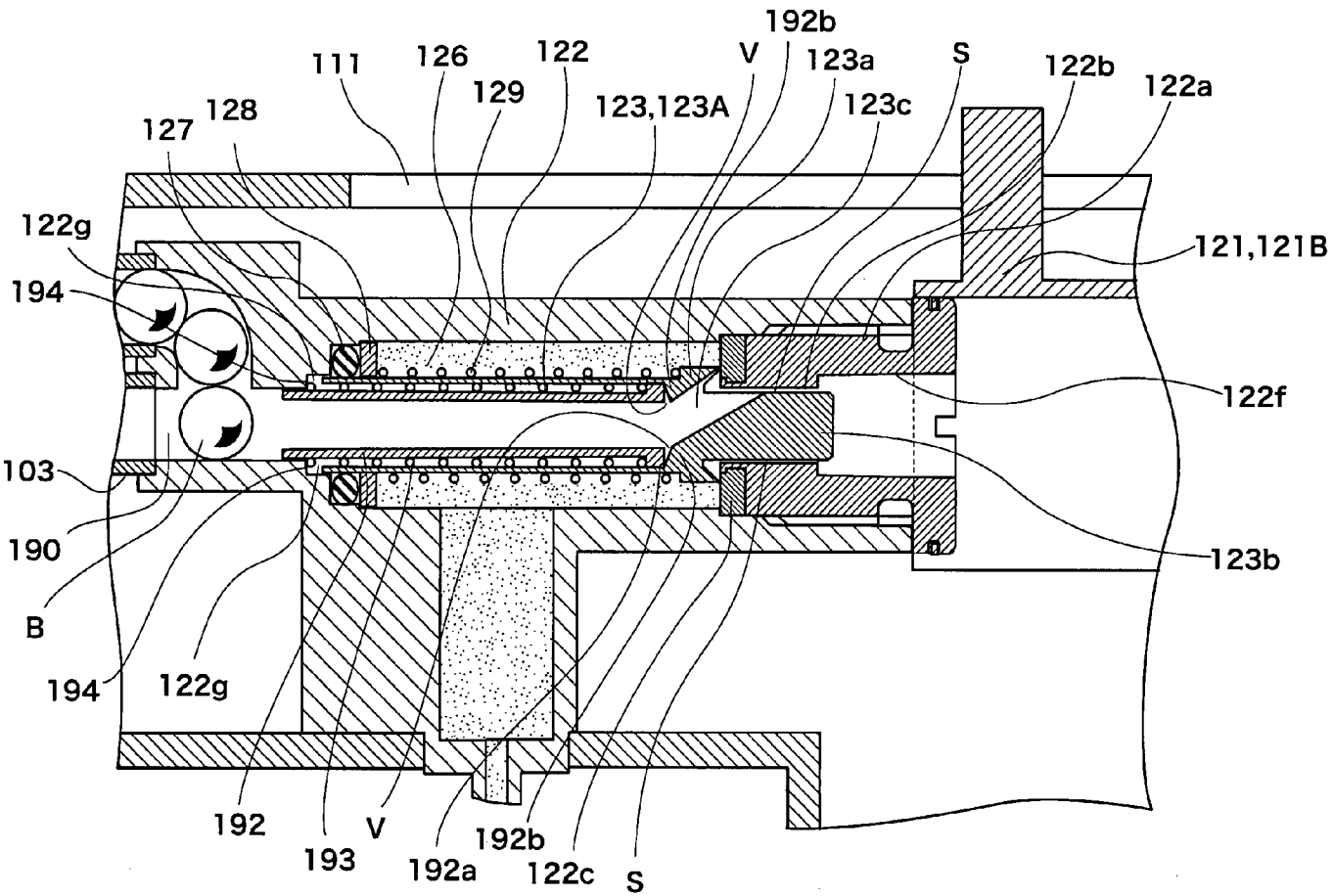
FIG. 4 is a left side view illustrating how a discharge valve shuts the communication between a barrel and an air chamber.

FIG. 4 is a left side view illustrating how the discharge valve 123 shuts the communication between the barrel 113 and the air chamber 126. The dot meshed portions in FIG. 4 indicate areas filled with compressed gas. The discharge valve 123 is a cylindrical member and its front end face is open. The outside diameter of the discharge valve 123 is smaller than the inside diameter of the valve body 122. The discharge valve 123 is positioned in the valve body 122 and forms the air chamber 126 between the valve body 122 and the discharge valve 123.

The discharge valve 123 has a flange portion 123*a* and a slide projection 123*b* at its rear end area. The flange portion 123*a* is protruded from the outer circumferential surface of the discharge valve 123 in the radial direction. The slide projection 123*b* is protruded from the rear end face of the discharge valve 123.

The discharge valve 123 has a communicating passage 123*c*. The communicating passage 123*c* is a cylindrical space inclined from the direction in which the internal space of the discharge valve 123 is extended. One end of the communicating passage 123*c* communicates with the internal space of the discharge valve 123. An opening at the other end of the communicating passage 123*c* appears between the flange portion 123*a* and the slide projection 123*b*.

In the front end area of the outer circumferential surface of the discharge valve 123, an O-ring 127 and a washer 128 are installed. The O-ring 127 is sandwiched between the washer 128 and the inner wall of the valve body 122. The washer 128 is positioned next to the rear part of the O-ring 127. One end of the discharge valve spring 129 is brought into contact with the rear surface of the washer 128. The discharge valve spring 129 is placed so that it is wound around the discharge valve 123. The other end of the discharge valve spring 129 is brought into contact with the flange portion 123*a*. The discharge valve spring 129 pushes the washer 128 and thereby presses the O-ring 127 against the inner wall of the valve body 122. Further, the discharge valve spring 129 pushes the flange portion 123*a* of the discharge valve 123 backward to press the flange portion 123*a* against the packing 122*c* and thereby positions the discharge valve 123 in a closed position 123A. At this time, the air chamber 126 becomes air-tight. In this state, gas introduced from the gas introducing portion 122*d* into the air chamber 126 does not leak from the front part or rear part of the valve body 122.

The internal space of the discharge valve 123 is provided with the bullet feed nozzle 192 and the bullet feed nozzle spring 193. The bullet feed nozzle 192 is a cylindrical member. The outside diameter of the front end of the bullet feed nozzle 192 is smaller than both the inside diameter of the barrel 113 and the inside diameter of the bullet connection passage 190. The rear end of the bullet feed nozzle 192 is provided with a bullet feed nozzle flange portion 192*a*. The bullet feed nozzle flange portion 192*a* is in slidable contact with the inner circumferential surface of the discharge valve 123. The bullet feed nozzle spring 193 is placed so that it is wound around the outer circumference of the bullet feed nozzle 192. The other end of the bullet feed nozzle spring 193 is in contact with a locking stepped portion 194 that forms a space 122*g*. One end of the bullet feed nozzle spring 193 is in contact with the bullet feed nozzle flange portion 192*a* and presses the bullet feed nozzle flange portion 192*a* against a coming-off preventing projection 192*b*. The coming-off preventing projection 192*b* is a portion positioned in the boundary between the internal space of the discharge valve 123 and the communicating passage 123*c* and protruded inward of the discharge valve 123. An air gap V into which compressed gas gets is formed between the coming-off preventing projection 192*b* and an end face of the bullet feed nozzle flange portion 192*a*.

In FIG. 4, the bolt 121 is positioned in the retreat position 121B at the rear part of the toy gun 101. The retreat position 121B refers to a position of the bolt 121 where the abutment portion 121*e* is caused to break away from the slide projection 123*b* of the discharge valve 123. At this time, the discharge valve 123 is pushed backward by the discharge valve spring 129.

Figure 5:
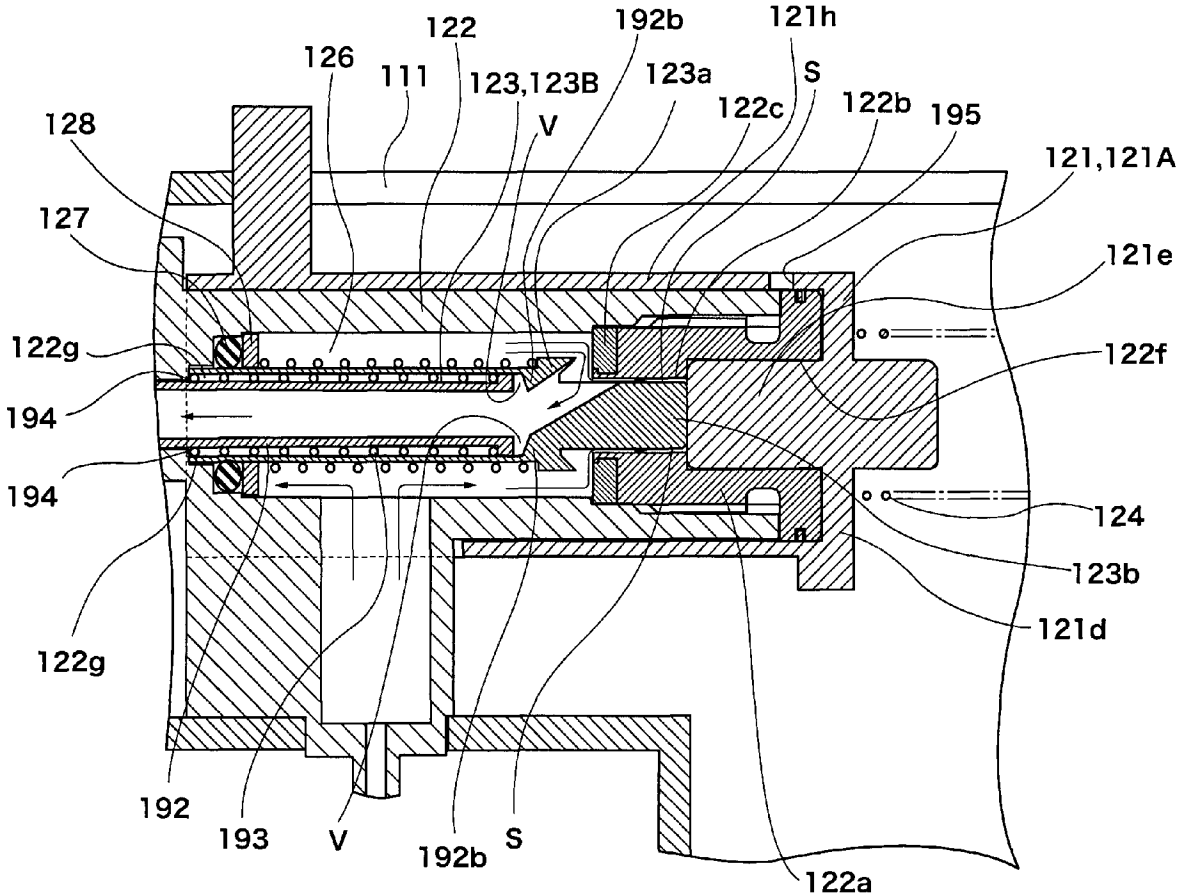
FIG. 5 is a left side view illustrating how the discharge valve opens the communication between the barrel and the air chamber.

FIG. 5 is a left side view illustrating how the discharge valve 123 opens the communication between the barrel 113 and the air chamber 126. The arrows in FIG. 5 indicate the movement of compressed gas. In FIG. 5, the bolt 121 is positioned in the pressing position 121A at the front part of the toy gun 101. The pressing position 121A refers to a position of the bolt 121 where the abutment portion 121e is abutted against the slide projection 123b of the discharge valve 123 to push the discharge valve 123 forward. At this time, the discharge valve 123 is moved forward and is positioned in an open position 123B where the communication between the discharge valve 123 and the air chamber 126 is opened. When the bolt 121 is positioned in the pressing position 121A, the abutment portion 121*e* of the bolt 121 enters the fitting hole 122*f* and pushes the slide projection 123*b* forward. This causes the discharge valve 123 to slide toward the space 122*g* in the valve body 122. As a result, the flange portion 123*a* breaks away from the packing 122*c*.

The compressed gas filled in the air chamber 126 flows into the internal space of the discharge valve 123 through a gap formed between the flange portion 123*a* and the packing 122*c* as indicated by arrows in FIG. 5. Part of the compressed gas that flowed in gets into the air gap V and hits the bullet feed nozzle flange portion 192*a* to cause the bullet feed nozzle 192 to advance. The bullet feed nozzle 192 pushes the rear face of the bullet B (Refer to FIG. 4) positioned in the bullet connection passage 190 (Refer to FIG. 4) by its front end and fits this bullet B into the barrel 113 (Refer to FIG. 4). The other part of the compressed gas that flowed into the internal space of the discharge valve 123 passes through the internal space of the bullet feed nozzle 192 and is jetted out to the bullet connection passage 190 to push the bullet B forward.

Further, when the flange portion 123*a* and the packing 122*c* breakaway from each other, the compressed gas also enters the air gap S and passes through the through hole 122*b* as indicated by arrows in FIG. 5. This compressed gas hits against the abutment portion 121*e* of the bolt 121 and the closed end 121*d* of the rear part of the bolt 121 and pushes the bolt 121 backward.

When the discharge valve 123 moves forward, the discharge valve spring 129 pushes back the discharge valve 123. This causes the discharge valve 123 to slide backward and the flange portion 123*a* is brought into tight contact with the packing 122*c*. As a result, the air chamber 126 becomes air-tight again. In the air-tight state, the air chamber 126 is filled with compressed gas supplied from the compressed gas cylinder 102.

Description will be back to FIG. 2 again. Description will be given to each part provided in the rear portion of the toy gun 101. The toy gun 101 includes the trigger 105, a trigger spring 131, a bolt sear 132, and a bolt sear spring 133.

The trigger 105 is positioned in front of the grip 104 (not shown in FIG. 2). The trigger 105 is supported by the frame 111 so that it can be freely rotated around a fulcrum 105*a*. The trigger 105 can be freely displaced between a firing position 105A for firing bullets and a non-firing position 105B due to the fulcrum 105*a*. (The firing position is the position of the trigger 105 indicated by an alternate long and short dash line.) (The non-firing position is the position of the trigger 105 indicated by a solid line.) The trigger 105 has an operating portion 105*d* extended downward from the fulcrum 105*a*. Further, the trigger 105 has a backward extended portion 105*b* extended from the fulcrum 105*a* backward of the toy gun 101. The backward extended portion 105*b* has a bolt sear push-up portion 105*c* protruded upward from its upper surface.

The trigger spring 131 is positioned behind the operating portion 105*d*. The trigger spring 131 is attached to the frame 111. The trigger spring 131 pushes the trigger 105 clockwise and pushes the trigger 105 positioned in the firing position 105A back to the non-firing position 105B. When an operator pulls the operating portion 105*d* backward with his/her finger, the trigger 105 is positioned in the firing position 105A. When the operator thereafter removes his/her finger from the operating portion 105*d*, the trigger 105 is displaced to the non-firing position 105B.

The bolt sear 132 is provided above the bolt sear push-up portion 105*c* and under the bolt 121 in a position sandwiched between them. The bolt sear 132 is attached to the frame 111 so that it can be freely rotated around a shaft center 132*a*. The bolt sear 132 includes a flat plate-like forward protruded portion 132*b* and a backward protruded portion 132*c* fanned as laterally viewed. The forward protruded portion 132*b* is protruded forward of the shaft center 132*a*. The backward protruded portion 132*c* is protruded backward of the shaft center 132*a*. The upper part of the backward protruded portion 132*c* is a stopper portion 132*d* for stopping the locking projection 121*f* of the bolt 121. The bolt sear spring 133 is abutted against the under surface of the backward protruded portion 132*c*. The bolt sear spring 133 rotates the bolt sear 132 counterclockwise. When the bolt sear push-up portion 105*c* pushes upward the under surface of the forward protruded portion 132*b* in this bolt sear 132, the following takes place: the stopper portion 132*d* is displaced downward and the bolt sear 132 is positioned in a permission position 132A (the position of the bolt sear 132 indicated by an alternate long and short dash line). The permission position 132A refers to a position where the stopper portion breaks away from the path of the movement of the locking projection 121*f* of the bolt 121 and the reciprocating motion of the bolt 121 in the back and forth direction is permitted. Meanwhile, when the bolt sear push-up portion 105*c* breaks away from the bolt sear 132, the following takes place: the stopper portion 132*d* is displaced upward by the bolt sear spring 133 and the bolt sear 132 is positioned in an arrest position 132B (the position of the bolt sear 132 indicated by a solid line). The arrest position 132B refers to a position where the stopper portion interferes with the path of the movement of the locking projection 121*f* of the bolt 121 and the reciprocating motion of the bolt 121 is arrested.

Figure 6:
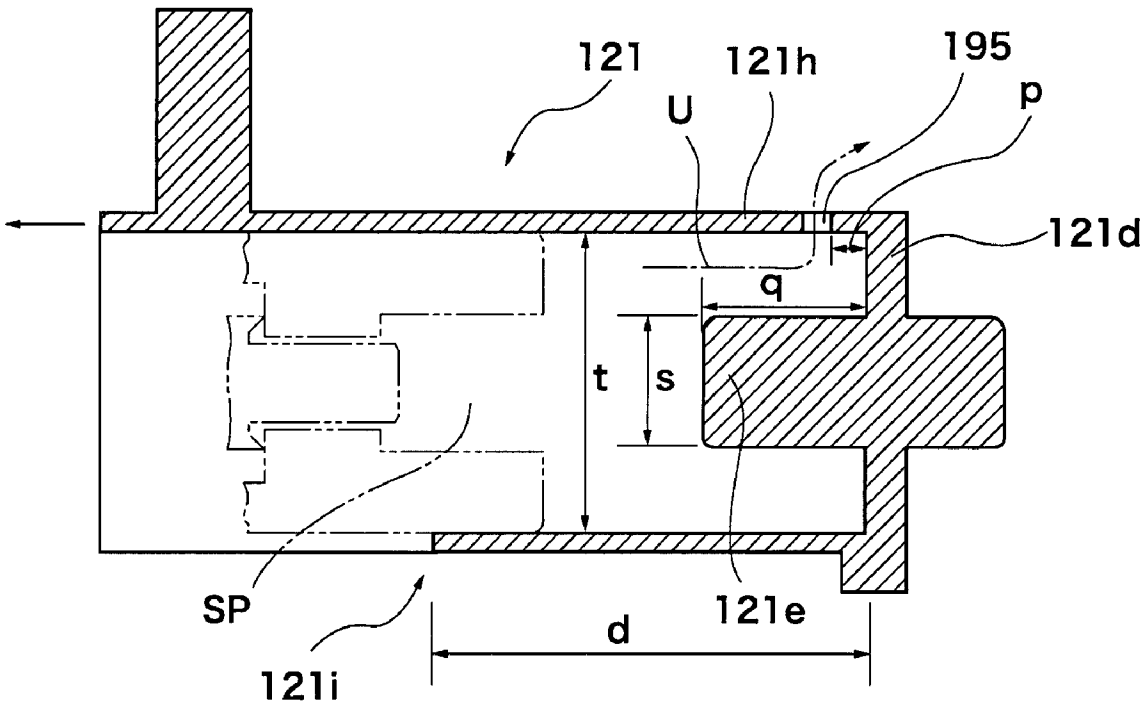
FIG. 6 is a left sectional view of a bolt.
Figure 7:
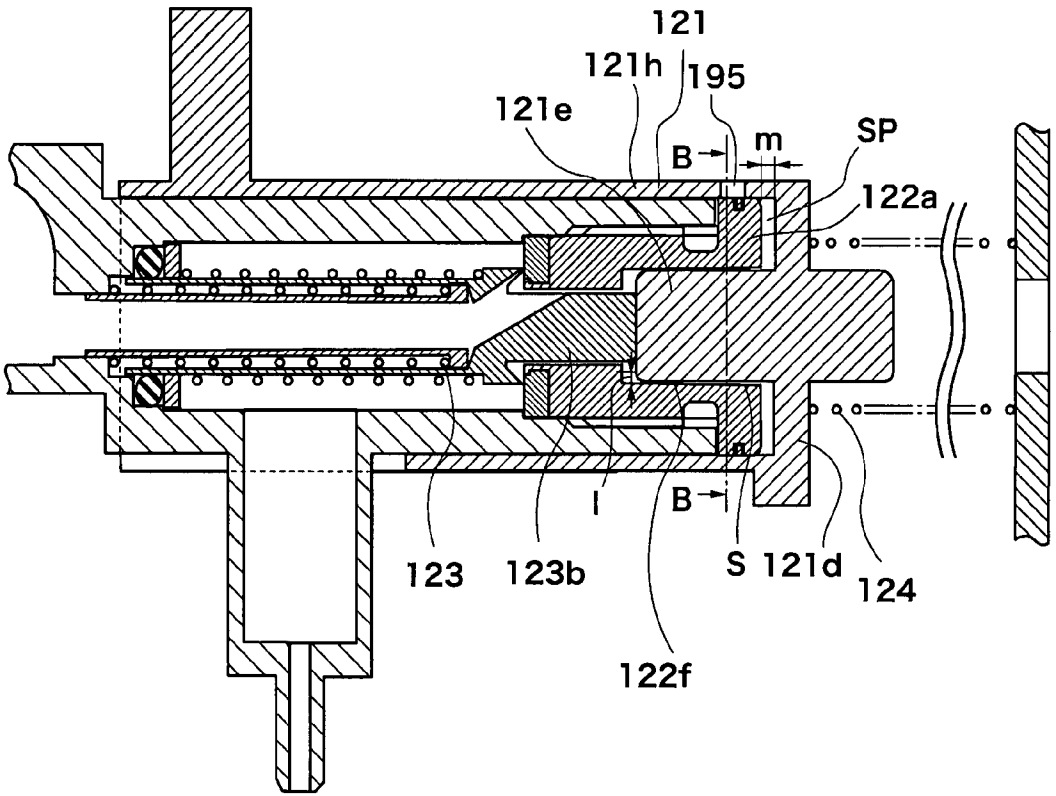
FIG. 7 is a left sectional view of a bolt with an abutment portion abutted against a slide projection of a discharge valve.

More detailed description will be given to the structure of the bolt 121. FIG. 6 is a left sectional view of the bolt 121. FIG. 7 is a left sectional view of the bolt 121 with the abutment portion 121*e* abutted against the slide projection 123*b* of the discharge valve 123. FIG. 7 illustrates the state obtained immediately before the discharge valve 123 starts to move forward and the flange portion 123*a* is not away from the packing 122*c*. Hereafter, description will be given with reference to FIG. 6 and FIG. 7. The cylindrical portion 121*h* of the bolt 121 is provided with a second opening 195. The second opening 195 causes the interior of the fit receiving portion 121*i* and the exterior of the bolt 121 to communicate with each other and forms a gas flow path U.

The bolt 121 is pushed by the bolt spring 124 and makes linear slide movement toward the front part of the toy gun 101. As a result, the abutment portion 121*e* gets into a fitting hole 122*f* that forms part of the through hole 122*b* and is brought into contact with the slide projection 123*b* (FIG. 7).

FIG. 5 referred to above illustrates the following state in the form of left side sectional view, following FIG. 7: a state in which the abutment portion 121*e* pushes forward the slide projection 123*b* of the discharge valve 123 and the flange portion 123*a* is away from the packing 122*c*. The compressed gas filled in the air chamber 126 flows backward by way of the air gap S as indicated by arrows in FIG. 5 and pushes backward the abutment portion 121*e* and the closed end 121*d* of the bolt 121. This shifts the movement of the bolt 121 from forward movement to backward movement.

Description will be given to the action of each part that occurs when a user uses the toy gun 101 with reference to FIG. 2 and FIG. 8 to FIG. 10. First, description will be given with reference to FIG. 2. A user using the toy gun 101 holds the toy gun 101 so that the barrel 113 is horizontally positioned. As a result, a bullet B in the magazine 112 free-falls and arrives at a position corresponding to the open end 112*d* of the magazine 112 in the bullet connection passage 190.

Subsequently, the user performs operation of pulling the protruded portion 121*a* backward of the toy gun 101. FIG. 2 depicts the internal structure of the toy gun 101 with the bolt 121 positioned backward as mentioned above. In process of the bolt 121 moving backward, the locking projection 121*f* of the bolt 121 is abutted against the upper surface of the stopper portion 132*d* of the bolt sear 132 and climbs over the stopper portion 132*d*. After the locking projection 121*f* climbs over the stopper portion 132*d*, the bolt sear 132 is rotated counterclockwise by the elastic force of the bolt sear spring 133. At this time, the bolt 121 becomes apt to move forward of the toy gun 101 by the elastic force of the bolt spring 124. However, the locking projection 121*f* of the bolt 121 hitches on the stopper portion 132*d* and does not move forward any more.

When the user pulls the trigger 105 backward in this state, the trigger 105 rotates counterclockwise and the bolt sear push-up portion 105*c* displaces the forward protruded portion 132*b* of the bolt sear 132 upward to rotate the bolt sear 132 clockwise. This removes the engagement between the locking projection 121*f* of the bolt 121 and the stopper portion 132*d* of the bolt sear 132. Thereafter, the bolt 121 is pushed by the bolt spring 124 and moves forward.

Figure 8:
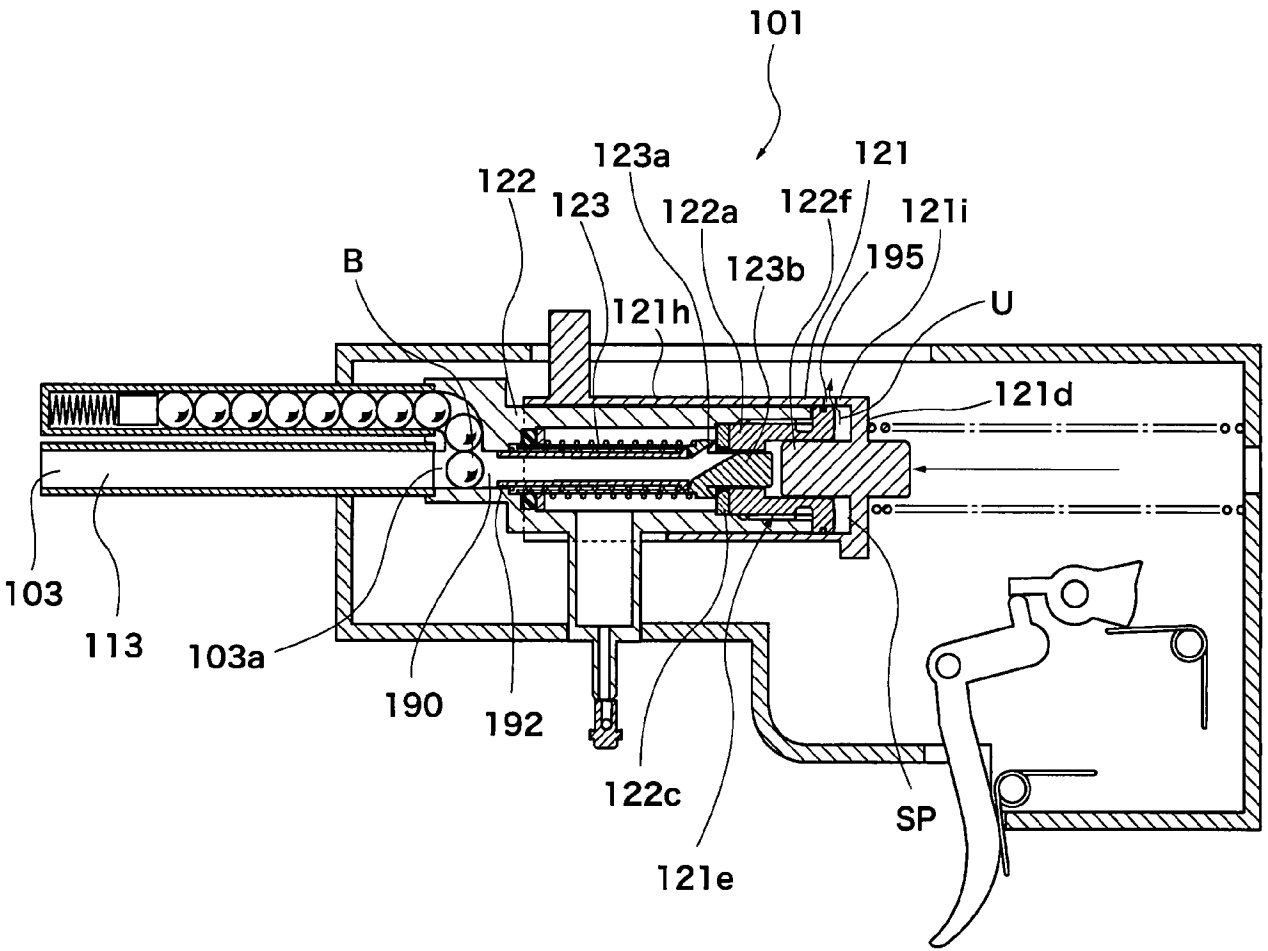
FIG. 8 is a left side view illustrating the internal structure of the toy gun with the bolt moved forward, following FIG. 2.
Figure 9:
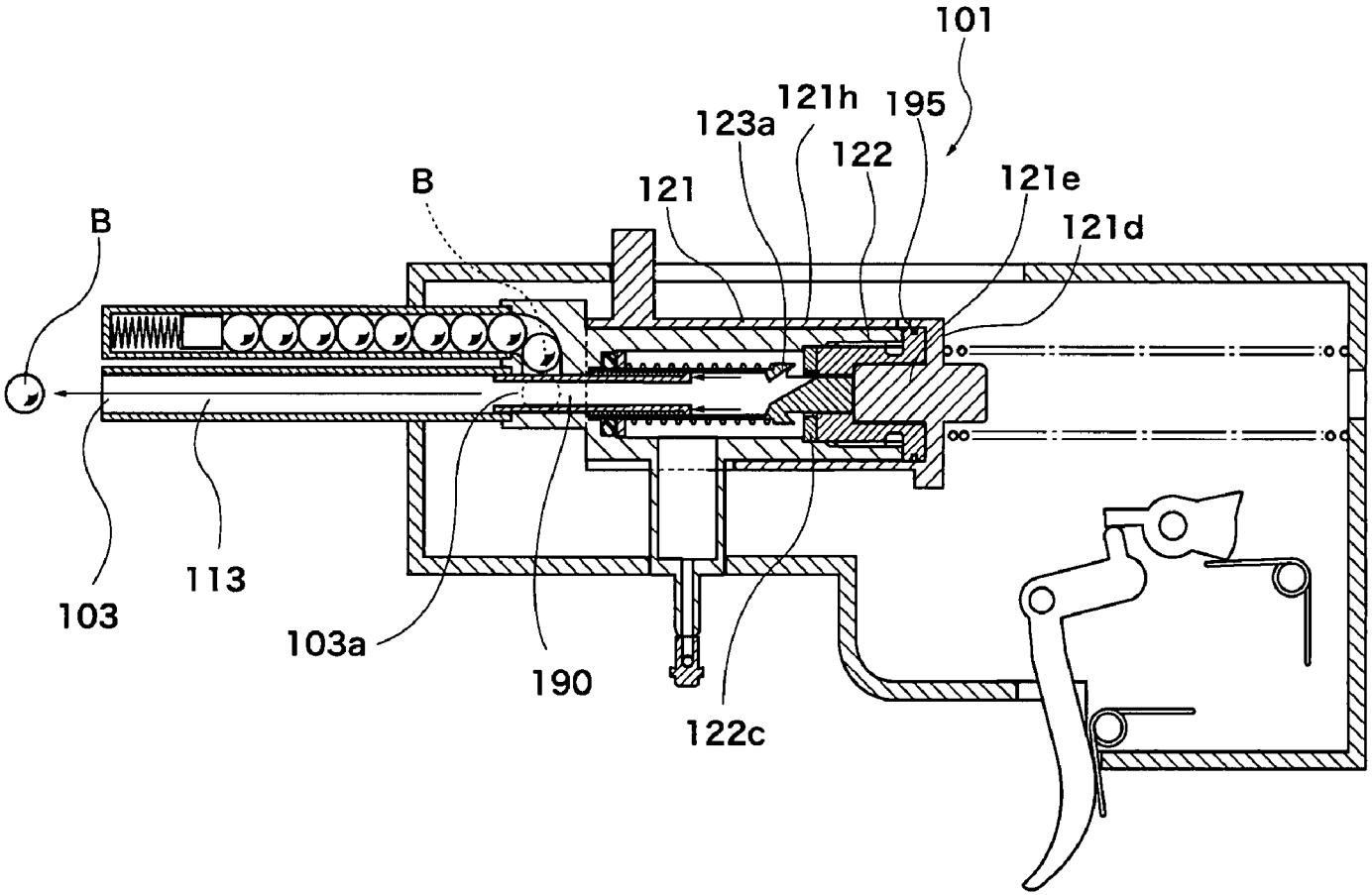
FIG. 9 is a left side view illustrating the internal structure of the toy gun obtained immediately after a bullet is fired off, following FIG. 8.

FIG. 8 is a left side view illustrating the internal structure of the toy gun 101 with the bolt 121 moved forward, following FIG. 2. FIG. 9 is a left side view illustrating the internal structure of the toy gun 101 obtained immediately after a bullet B is fired off, following FIG. 8. When the bolt 121 moves forward, the following takes place: the abutment portion 121*e* gets into the fitting hole 122*f* in the rear lid 122*a* and pushes forward the slide projection 123*b* of the discharge valve 123. This causes the flange portion 123*a* to be away from the packing 122*c*. At this time, the compressed gas gets into the internal space of the discharge valve 123 through the gap between the flange portion 123*a* and the packing 122*c* and pushes the bullet feed nozzle 192 forward. Further, the compressed gas passes forward through the internal space of the bullet feed nozzle 192. As a result, the rear face of a bullet B in the bullet connection passage 190 is pushed by the compressed gas and the front end of the bullet feed nozzle 192. It passes through the barrel 113 and is fired off from the muzzle 103. After the bullet B is fired off, another bullet B is fed from the magazine 112 to the bullet connection passage 190. (Refer to FIG. 10.)

When the bolt 121 moves' forward, the air in the space SP encircled by the fit receiving portion 121*i* and the rear lid 122*a* is discharged to outside the bolt 121 through the second opening 195. The bolt 121 rapidly presses the slide projection 123*b* without being decelerated by the air in the space SP while the bolt 121 is moving forward and until the second opening 195 is closed by the valve body 122. When the bolt 121 thereafter moves forward to a position where the valve body 122 closes the second opening 195, the flow path U is shut off.

Figure 10:
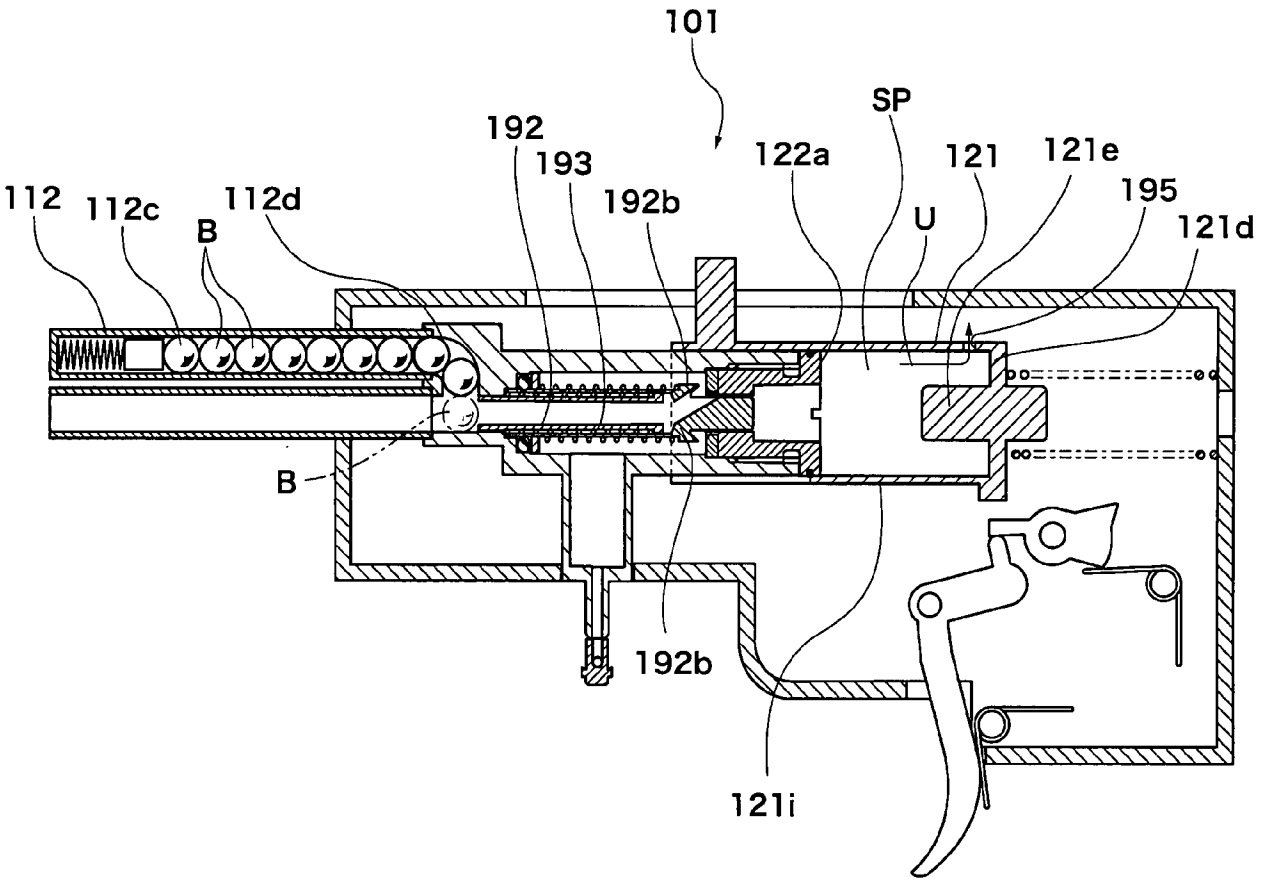
FIG. 10 is a left side view illustrating the internal structure of the toy gun with the bolt retreated, following FIG. 9.

FIG. 10 is a left side view illustrating the internal structure of the toy gun 101 with the bolt 121 retreated, following FIG. 9. When the abutment portion 121*e* and the closed end 121*d* are pushed by the compressed gas that flowed into the space SP through the air gap S, the bolt 121 is moved backward. If the flow path U has been shut off at this time, the compressed gas that flowed into the space SP encircled by the fit receiving portion 121*i* and the rear lid 122*a* is all used as power for pushing the bolt 121 backward. When the bolt 121 moves backward by a predetermined distance, the flow path U is ensured again. However, the compressed gas rapidly flows into the space SP and the closed end 121*d* is pushed by great power. For this reason, the bolt 121 retreats at sufficient speed. Thus the user using the toy gun 101 can feel high impact from the retreating bolt 121. The bullet feed nozzle 192 is pushed by the bullet feed nozzle spring 193 and moves backward until it is abutted against the coming-off preventing projection 192*b*.

While the user pulls and keeps the trigger 105 backward, the bolt sear push-up portion 105*c* keeps pushing the forward protruded portion 132*b* of the bolt sear 132 upward. For this reason, the stopper portion 132*d* of the bolt sear push-up portion 105*c* remains downward. As a result, the bolt 121 is not stopped by the bolt sear 132 and moves backward as far as it will go and is then pushed by the bolt spring 124 and starts to move forward in turn. Thus the bolt 121 receives the elastic force of the bolt spring 124 and the pressure of the compressed gas and makes reciprocating motion. While it reciprocates once, it is abutted against and breaks away from the discharge valve 123 to open and shut the communication between the barrel 113 and the air chamber 126. In the toy gun 101, then, the action illustrated in FIG. 2 and FIG. 8 to FIG. 10 is repeated and bullets B are fired off from the muzzle 103 in rapid succession.

According to the toy gun 101 in this embodiment, as mentioned above, the following takes place when the bolt 121 moves forward with the valve body 122 fit in the first opening 121*g*: air in the fit receiving portion 121*i* is discharged to outside by way of the second opening 195 and impact produced when the bolt 121 pushes the discharge valve 123 is not weakened. After a bullet B is fired off, compressed gas rapidly flows into the fit receiving portion 121*i* of the bolt 121 and pushes the bottom portion (closed end 121*d*) of the bolt 121, and the bolt 121 retreats at sufficient speed. For this reason, high impact is produced when a bullet is fired off and at the time of blowback with the toy gun 101 so configured as to fire off bullets B by gas pressure. This can be implemented without largely modifying the structure of the bolt 121 that moves the discharge valve 123 for controlling a jet of compressed gas.

The present inventors used the toy gun 101 in this embodiment under the condition of 10 degrees to 35 degrees centigrade and the following findings were obtained. In this case, the fit receiving portion 121*i* was cylindrical and its diameter t (Refer to FIG. 6) was 15.4 mm (sectional area: 186.17 $mm^2$); its depth d (Refer to FIG. 6) was 22.5 mm; and its volumetric capacity was 4190.963 $mm^3$ (however, the volumetric capacity for which the abutment portion 121*e* accounts is excluded). The second opening 195 was circular and it was provided at a distance p (Refer to FIG. 6) of 2.5 mm from the inner bottom face (face on the front side of the closed end 121*d*) of the bolt 121. The abutment portion 121*e* was columnar and its axial center ran through the center point of the closed end 121*d*. The diameter s (Refer to FIG. 6) of the abutment portion 121*e* was 6.0 mm. The height q (Refer to FIG. 6) of the abutment portion 121*e* was 8.55 mm. The volumetric capacity for which the abutment portion 121*e* accounted in the fit receiving portion 121*i* was 241.746 $mm^3$. Carbonic acid gas was used for the compressed gas. The separation distance m (Refer to FIG. 7) between the rear lid 122*a* and the closed end 121*d* obtained when the abutment portion 121*e* was fit into the fitting hole 122*f* and abutted against the slide projection 123*b* was 1.0 mm. At this time, the air gap S looked like a ring as viewed in the section taken along line B-B of FIG. 7. The width of this ring, that is, the separation distance 1 (Refer to FIG. 7) between the side face of the abutment portion 121*e* and the inner side face of the fitting hole 122*f* was 0.7 mm.

The present inventors varied the diameter of the second opening 195 to check the sense of use of the toy gun 101 and obtained the following result:

| The diameter (opening area) of the second opening 195 | |
|---|---|
| | Sense of use |
| 1.5 mm (1.77 $mm^2$) | Inadequate |
| 2.0 mm (3.14 $mm^2$) | Adequate |
| 2.5 mm (4.91 $mm^2$) | Inadequate |

More detailed description will be given. When the diameter of the second opening 195 was 2.0 mm, a favorable sense of use was obtained with the toy gun 101 both when a bullet is fired off and at the time of blowback. When the diameter of the second opening 195 was 1.5 mm, the following problem arose though a bullet B was fired off from the muzzle 103: when the bolt 121 advanced, the air in the space SP was not favorably discharged from the second opening 195 and the forward speed of the bolt 121 was reduced by the air in the space SP. When the diameter of the second opening 195 was 2.5 mm, the following problem arose though a bullet B was fired off from the muzzle 103: when the bolt 121 retreated (at the time of blowback), a large quantity of compressed gas leaked from the second opening 195 and the closed end 121*d* could not sufficiently receive the pressure of compressed gas. As a result, the backward speed of the bolt 121 was reduced.

From the above findings, it presumed that the following is implemented when the second opening 195 is provided in a rear position where the distance p from the inner bottom face of the bolt 121 is less than 2.5 mm (the inner bottom face is equivalent to the face on the front side of the closed end 121*d*): the time for which the flow path U is shut off at the time of the movement of the bolt 121 (bullet firing and blowback) is further shortened and the sense of use of the toy gun 101 is further improved.

Figure 11:
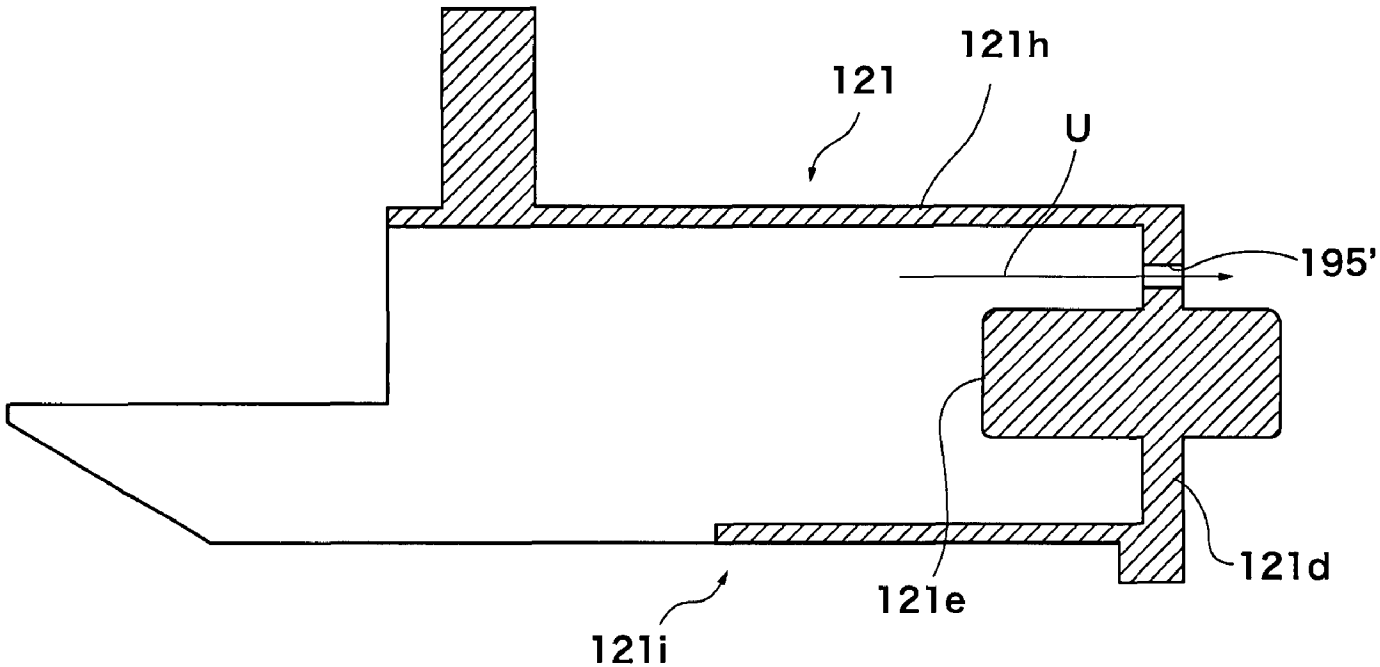
FIG. 11 is a left sectional view of a bolt in a second embodiment.

Subsequently, description will be given to another embodiment with reference to FIG. 11. This embodiment will be designated as second embodiment for the sake of convenience. The same portions as in the first embodiment will be marked with the same reference numerals and the description thereof will be omitted. FIG. 11 is a left sectional view of the bolt 121. In this embodiment, the second opening 195' is provided in the closed end 121*d* that forms the bottom portion of the fit receiving portion 121*i*. The gas flow path U illustrated in FIG. 11 is ensured by this second opening 195'. Also in the toy gun 101 in this embodiment, impact produced when the bolt 121 pushes the discharge valve 123 is not weakened and the bolt 121 retreats at sufficient speed after a bullet B is fired off. For this reason, high impact is produced when a bullet is fired off and at the time of blowback with the toy gun 101 so configured that bullets B are fired off by gas pressure. This can be implemented without largely modifying the structure of the bolt 121 that moves the discharge valve 123 for controlling a jet of compressed gas.

Both in the first embodiment and in the second embodiment, the toy gun 101 is of continuous firing type. As other embodiments, the second opening 195, 195' can also be applied to single firing toy guns and burst toy guns.

Obviously, numerous modifications and variations of the present invention are possible in light of the above teachings.

It is therefore to be understood that within the scope of the appended claims, the invention may be practiced otherwise than as specifically described herein.

What is claimed is:

1. A toy gun comprising:

a barrel extended in the back and forth direction of the body of the gun;

a valve body formed in the shape of a cylinder extended in the back and forth direction of the body of the gun, having an air chamber to be filled with compressed gas formed therein, communicating with the rear-side end of the barrel on the front side, and having on the rear side a through hole penetrating the valve body in the back and forth direction of the body of the gun;

a discharge valve positioned in the valve body and so provided that the discharge valve can be displaced between a closed position which shuts the communication between the barrel and the air chamber and an open position which is located ahead of the closed position and opens the communication between the barrel and the air chamber;

a discharge valve spring pushing the discharge valve backward and positioning the discharge valve in the closed position;

a bolt provided so as to freely slide in the back and forth direction of the body of the gun, including: a fit receiving portion which forms an first opening in front and forms a second opening behind the first opening and to which the outer circumference of the valve body on the rear side is fit through the first opening; and an abutment portion provided on the bottom portion of the fit receiving portion opposite to the first opening, and displaced between a pressing position in which the abutment portion is abutted against the discharge valve and the discharge valve is positioned in the open position, and a retreat position which is positioned behind this pressing position and in which the abutment portion is caused to be away from the discharge valve; and a bolt spring pushing the bolt forward.

2. The toy gun of claim 1, wherein:

the second opening penetrates part of the side portion of the fit receiving portion.

3. The toy gun of claim 1, wherein:

the second opening penetrates part of the bottom portion of the fit receiving portion.

4. The toy gun of claim 1, wherein:

the sectional area of the fit receiving portion is 186.17 $mm^2$, and the opening area of the second opening is not less than 1.77 $mm^2$ and not more than 4.91 $mm^2$.

5. The toy gun of claim 2, wherein:

the sectional area of the fit receiving portion is 186.17 $mm^2$, and the opening area of the second opening is not less than 1.77 $mm^2$ and not more than 4.91 $mm^2$.

6. The toy gun of claim 3, wherein:

the sectional area of the fit receiving portion is 186.17 $mm^2$, and the opening area of the second opening is not less than 1. 77 $mm^2$ and not more than 4.91 $mm^2$.

7. A bullet firing device comprising:

a valve body having a shape of a cylinder extended in the back and forth direction, and forming therein an air chamber to be filled with compressed gas;

a discharge valve positioned in the valve body and so provided that the discharge valve can be displaced between a closed position where the communication from the air chamber to a spatial area outside the valve body by way of the front end portion of the valve body is shut and an open position, located in the front of the closed position, where the communication is opened;

a discharge valve return portion pushing backward the discharge valve positioned in the open position, and positioning the discharge valve in the closed position;

a bullet feed nozzle having a shape of a cylinder extended in the back and forth direction, and moved forward by compressed gas going from the air chamber to the front end portion of the valve body when the communication is opened; and a bullet feed nozzle return portion pushing back the bullet feed nozzle moved forward.

8. The bullet firing device of claim 7, wherein:

the rear end portion of the discharge valve is fit into the rear end portion of the valve body, and moved forward when pushed from outside the valve body.

9. The bullet firing device of claim 7, wherein:

the discharge valve has a shape of a cylinder, and the bullet feed nozzle is placed inside the discharge valve.

10. The bullet firing device of claim 8, wherein:

the discharge valve has a shape of a cylinder, and the bullet feed nozzle is placed inside the discharge valve.

11. The bullet firing device of claim 7, wherein:

at least any one of the discharge valve return portion and the bullet feed nozzle return portion is a spring.

12. The bullet firing device of claim 8, wherein:

at least any one of the discharge valve return portion and the bullet feed nozzle return portion is a spring.

13. The bullet firing device of claim 9, wherein:

at least any one of the discharge valve return portion and the bullet feed nozzle return portion is a spring.

14. The bullet firing device of claim 10, wherein:

at least any one of the discharge valve return portion and the bullet feed nozzle return portion is a spring.

* * * * *